United States Patent [19]

Kowalczyk

[11] 4,114,481

[45] Sep. 19, 1978

[54] OIL FILTER WRENCH WITH RATCHET DRIVE

[75] Inventor: Adolph J. Kowalczyk, Minneapolis, Minn.

[73] Assignee: J-Mark Quality Products, Inc., Minneapolis, Minn.

[21] Appl. No.: 817,930

[22] Filed: Jul. 22, 1977

[51] Int. Cl.[2] ..... B25B 13/52
[52] U.S. Cl. ..... 81/64
[58] Field of Search ..... 81/64, 3.43

[56] References Cited

U.S. PATENT DOCUMENTS

| | | | |
|---|---|---|---|
| 1,400,456 | 12/1921 | Petrak | 81/64 |
| 2,897,705 | 8/1959 | Rozmus | 81/64 |
| 3,686,984 | 8/1972 | Kelso | 81/64 |

*Primary Examiner*—James L. Jones, Jr.
*Attorney, Agent, or Firm*—H. Dale Palmatier

[57] ABSTRACT

An oil filter rotating wrench including a looped band, the ends of which are connected together by a drive fitting formed of rigid panels in confronting and spaced relation to each other and interconnected at one side edge portion, the confronting panels having aligned socket openings in which the detented lug of a ratchet drive is inserted for turning the drive fitting to tighten the band onto the oil filter and cause rotation thereof.

4 Claims, 4 Drawing Figures

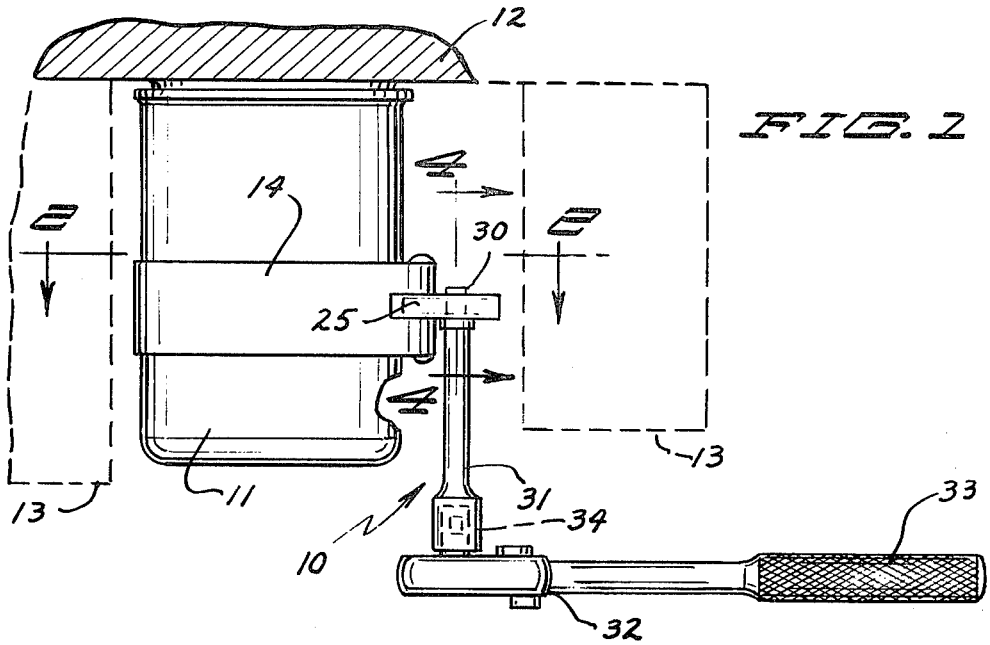
FIG. 1
FIG. 2
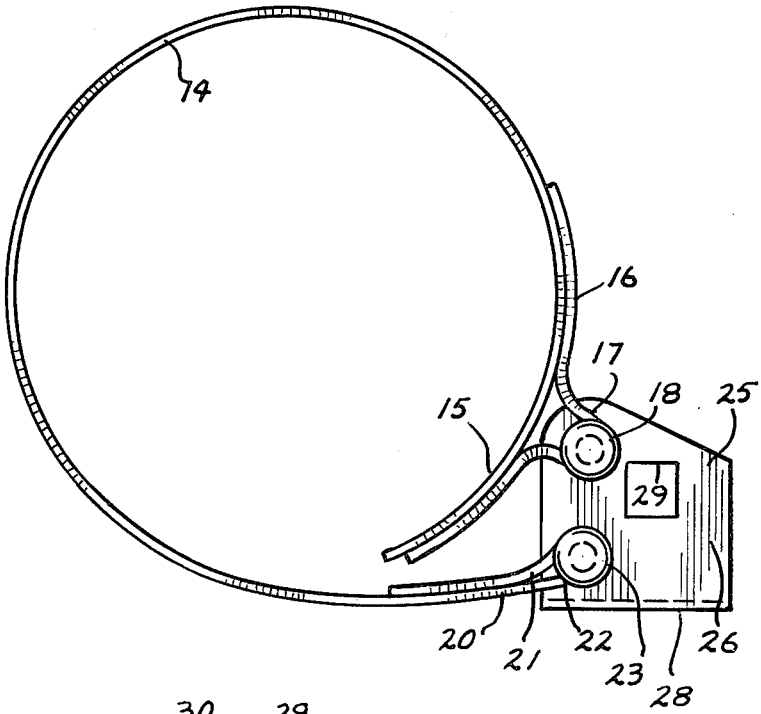
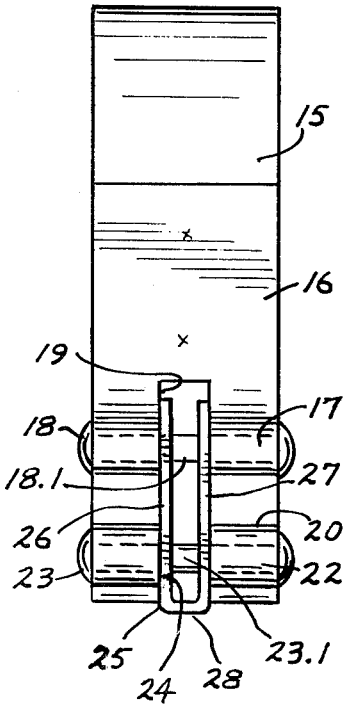
FIG. 3
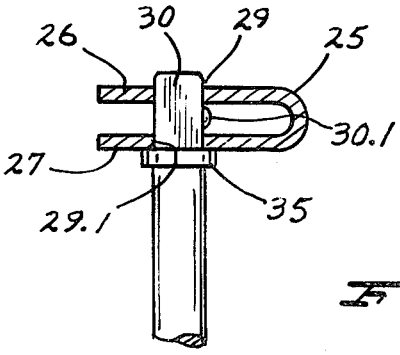
FIG. 4

OIL FILTER WRENCH WITH RATCHET DRIVE

This invention relates to a wrench for tightening and loosening the oil filter in an automobile engine.

BACKGROUND OF THE INVENTION

Automobile engines and closely related accessories and auxiliary equipment occupy more and more of the available space in the engine compartment. As a result, less and less space is available for the purpose of obtaining ready access, with tools, to such items as oil filters.

Oftentimes the spaces remaining to the side of an oil filter are so minimal that an oil filter turning wrench can hardly be attached, and there is practically no room available to facilitate moving the tool for the purpose of turning the filter.

Previous oil filter wrenches have been devised for use with a ratchet wrench and extension; however, such previous oil filter wrenches have had distinct problems in assuring that the ratchet wrench or extension will remain attached to the filter wrench.

SUMMARY OF THE INVENTION

The present invention improves oil filter wrenches which are adapted to be driven by a ratchet wrench, either with or without an extension. The present invention can be readily attached to an oil filter and then the ratchet wrench may be attached to the filter wrench for turning it. Otherwise the oil filter wrench may be first assembled with the ratchet wrench and then slipped onto the oil filter to turn the filter. The present invention is well adapted for use in tight places where the mechanic's vision may be significantly obstructed so that once the oil filter wrench is connected to the filter, the ratchet will not readily become disengaged.

Furthermore, the ratchet wrench will connect to the oil filter wrench in any of a number of positions so that regardless of the nature and size of the obstructions near the oil wrench, the ratchet wrench or its drive extension may be securely attached to the oil filter wrench to accomplish the purpose of tightening or loosening the oil filter.

BRIEF DESCRIPTION OF THE DRAWINGS

FIG. 1 is an elevation view of the present invention shown attached to an automotive type oil filter.

FIG. 2 is a plan view of the oil filter wrench detached from the filter.

FIG. 3 is an end elevation view of the filter wrench.

FIG. 4 is an enlarged detail section view taken approximately at 4—4 in FIG. 1.

DETAILED SPECIFICATION

One form of the invention is shown in the drawings and is described herein. The oil filter wrench is indicated in general by numeral 10 and is adapted to turn an automotive type oil filter 11 which is mounted upon a wall portion of an automotive type engine 12 immediately adjacent and between other auxiliary equipment or accessories shown in FIG. 1 in dotted lines and indicated by the numeral 13 which may be mounted upon or closely adjacent the engine in close proximity with the oil filter 11. It will be recognized that such oil filters 11 are commonly connected by threaded devices to the automobile engine block 12 so that rotation of the filter is necessary to remove the filter from the engine and rotation of the filter is necessary for applying the filter to the engine.

The oil filter wrench 10 includes a looped band 14, which in most cases is made of high carbon spring steel, but may be formed of other substitute materials, including lower grade steel or other substitute materials. The band is sufficiently wide so that it may very firmly grip the outer periphery of the filter 11 for turning it. One end 15 of the looped band has a metal strap 16 affixed thereto as by welding and the strap 16 may have a U-shaped bight or saddle 17 formed therein to receive the shank of a rivet 18 therethrough. The saddle 17 is formed with a longitudinally extending slot 19 therethrough so as to expose a portion 18.1 of the shank of the pivot rivet 18.

The other end portion 20 of the looped band extends generally tangentially of the substantially circular loop formed by the band 14, and the end 20 is disposed outwardly of the end portion 15 and in substantially overlapped relation therewith. The end portion 20 is bent back upon itself as illustrated at 21 and is welded back upon itself so that a permanent loop or bight 22 is formed to receive the shank of a rivet 23. The loop or bight 22 also has a slot 24 therein so as to expose the intermediate portion 23.1 of the rivet 23.

A drive fitting 25 is formed of rigid sheet metal and has a substantially U-shaped configuration as illustrated in FIG. 3. The fitting 25 has a pair of substantially identically shaped connector panels 26 and 27 which form the legs of the U-shaped configuration so as to be arranged in spaced and confronting relation to each other. The panels 26 and 27 extend into the slots 19 and 24 adjacent the opposite ends of the looped band, and rivets 18 and 23 extend through apertures in the panels 26 and 27 so as to pivotally interconnect the drive fitting 25 with the opposite ends of the looped band.

It will be seen in FIG. 2, that the fitting 25 may be rotated with respect to both of the pivots 23 and 18 so as to draw the looped band inwardly for the purpose of tightly embracing and gripping the oil filter 11, or the fitting 25 may be swung in the opposite direction as to distend the looped fitting to release the filter.

The intermediate portion of the U-shaped configuration of fitting 25 defines a closed linear side 28 of the fitting which maintains the panels 26 and 27 in spaced relation to each other. It is to be particularly noted in FIG. 2 that the intermediate side portion 28 of the fitting extends in the same general direction as the end portion 20 of the looped band which direction is substantially tangential of the loop formed by the band.

The rigid connector panels of the drive fitting 25 have aligned socket openings 29 and 29.1, respectively, formed therein. These socket openings 29, in the form illustrated, are square so as to receive the drive lug 30 of the extension 31 of a ratchet wrench 32. The ratchet wrench 32 has a handle 33 and a primary drive lug 34 which rotates freely relative to the handle 33 in one direction, but is revolved with the handle 33 in the other direction. The extension 31 fits upon the drive lug 34 and provides a duplicate detented drive lug 30 which also has a ball detent 30.1 thereon. The ball detent 30.1 is spring pressed in an outward direction and is normally held in the position illustrated in FIG. 4, but as the ball detent passes through one of the socket openings 29, 29.1 in the fitting 25, the spring pressed ball detent is pushed transversely inwardly into the lug so as to allow the lug and detent to be seated in the socket opening.

A shoulder flange 35 to limit the depth to which the lug 30 may be moved into the socket openings.

Normally, the detent 30.1 will maintain a predetermined assembly and relationship between the lug 30 and the drive fitting 25 so that a predetermined relationship is maintained between the ratchet wrench 32 and the band 14. In this way, the band 14 may be applied to the filter 11 by merely manually manipulating the wrench 32, without requiring that the mechanic actually grip the band 14 and slide it on the filter. This allows the mechanic to insert the band into narrow places to which access is often restricted. In this way, the band 14 may be applied to a filter 11 so as to loosen the filter, and then be removed from the filter simply by manually holding and manipulating the wrench handle, and without ever physically engaging the bands with his hands.

Because the intermediate side 28 of the U-shaped configuration of fitting 25 extends in the general direction of the end portion 20 of the band which lies substantially tangentially of the loop, the fitting 25 will transfer a great deal of physical force to the band 14 without any unnecessary deformation of the fitting 25. This will allow the lug 30 to be easily withdrawn from the socket openings when desired, and will allow the lug 30 to be reinserted when the tool is next used so that the loosening or tightening of the filter can be accomplished expeditiously and simply.

It will be seen that I have provided a new and improved oil filter wrench to be driven by a ratchet type drive wherein the drive fitting which interconnects the ends of the looped band is formed with stiff panels defining the legs of a U-shaped configuration, through which panels are formed socket openings to receive the detented drive lug of a ratchet wrench and wherein the drive panels retain the detent therebetween and prevent the inadvertent disassembly of the ratchet drive from the looped band.

I claim:

1. An oil filter wrench to be driven by the detented drive lug of a ratchet wrench, comprising a looped band to embrace an oil filter and having lapped and proximate ends on adjacent pivots, one end being spaced outwardly of the other end, and a drive fitting connecting and retaining said pivots together and swingable relative to both ends of the band to draw the band together in close fitting and gripping relation on the filter, the drive fitting including a pair of rigid connector panels confronting each other in spaced relation and both lying normal to the pivot axes, the connector panels having aligned socket openings to receive the drive lug of a ratchet wrench and retain the detent of the lug in the space between the panels to thereby maintain the fitting on the lug while resisting movement of the fitting endwise along the lug, and the connector panels also having means maintaining the panels in spaced relation to each other.

2. The oil filter wrench according to claim 1 and the drive fitting having a U-shaped configuration wherein the legs of the U-shaped configuration comprise said rigid panels.

3. The oil filter wrench according to claim 2 and the outer end of the band extending generally tangentially of the loop of the band, the intermediate portion of the U-shaped configuration defines one side of the fitting wherein said one side extends in the direction of the tangentially oriented outer end of the band, and said one side of the fitting being linear, the socket opening being spaced from said one side in a direction perpendicular to said one side.

4. An oil filter wrench, comprising a looped band to embrace an oil filter and having lapped and proximate ends on adjacent pivots, one end of the band being spaced outwardly of the other end, a ratchet wrench having a handle and a drive lug with a detent, the drive lug being non-rotatable in one direction and rotatable in the opposite direction about an axis extending transversely of the handle, and a drive fitting connecting and retaining said pivots of the looped band together and the fitting being swingable relative to both ends of the band to draw the band into close fitting and gripping relation on the filter, the drive fitting including a pair of rigid connector panels confronting each other in spaced relation and both of the panels lying normal to the pivot axes, the connector panels having aligned socket openings into which the detented drive lug of the ratchet wrench extends, the detent of the lug being disposed between the two connector panels, the fitting having a U-shaped configuration wherein the legs of the U-shaped configuration comprise said rigid panels, the intermediate portion of the U-shaped configuration defining one side of the drive fitting wherein said one side extends along and adjacent to the outer end of the looped band which extends substantially tangentially of the loop.

* * * * *